US012545474B1

(12) United States Patent
Donadelle

(10) Patent No.: US 12,545,474 B1
(45) Date of Patent: Feb. 10, 2026

(54) MAGNETIC MODULAR STORAGE CASE

(71) Applicant: Adiana Donadelle, Lomita, CA (US)

(72) Inventor: Adiana Donadelle, Lomita, CA (US)

( * ) Notice: Subject to any disclaimer, the term of this patent is extended or adjusted under 35 U.S.C. 154(b) by 94 days.

(21) Appl. No.: 18/424,965

(22) Filed: Jan. 29, 2024

(51) Int. Cl.

| | |
|---|---|
| ***A45D 33/00*** | (2006.01) |
| ***B65D 21/08*** | (2006.01) |
| ***B65D 25/06*** | (2006.01) |
| ***B65D 25/14*** | (2006.01) |
| ***B65D 43/02*** | (2006.01) |

(52) U.S. Cl.
CPC ..... *B65D 21/083* (2013.01); *B65D 25/06* (2013.01); *B65D 25/14* (2013.01); *B65D 43/0202* (2013.01); *B65D 2203/02* (2013.01); *B65D 2313/04* (2013.01); *B65D 2543/00194* (2013.01)

(58) Field of Classification Search
CPC ..... A45D 33/22; A45D 33/008; A45D 33/20; A45D 33/24; A45D 40/24; A45D 40/22; A45D 40/221; B65D 2313/04; B65D 21/083
USPC ..... 206/1.8, 581, 1.7, 823, 1.9
See application file for complete search history.

(56) References Cited

U.S. PATENT DOCUMENTS

| | | | | |
|---|---|---|---|---|
| 2004/0003825 | A1* | 1/2004 | Kelly | A45D 33/22 132/301 |
| 2007/0131240 | A1* | 6/2007 | Prague | A45D 33/22 132/294 |
| 2014/0299151 | A1* | 10/2014 | Stroud | A45D 33/008 132/315 |
| 2020/0039699 | A1* | 2/2020 | Wu | B65D 43/0202 |

* cited by examiner

*Primary Examiner* — King M Chu
(74) *Attorney, Agent, or Firm* — Plager Schack LLP; Mark H. Plager; Michael J. O'Brien

(57) ABSTRACT

A magnetic modular storage assembly is configured to efficiently store components. The magnetic modular storage assembly has a thick middle container. A lid is detachably coupled to the thick middle container. A thin middle container is detachably coupled to the thick middle container. A lower container is detachably coupled to the thin middle container. The lid, the thick middle container, the thin middle container, and the lower container efficiently store components.

5 Claims, 10 Drawing Sheets

MAGNETIC MODULAR STORAGE CASE

BACKGROUND

The embodiments herein relate generally to travel containers.

Prior to embodiments of the disclosed invention, single use plastic travel sized bottles and containers and single use mini toiletries for personal care created excessive waste. Embodiments of the disclosed invention solve these problems.

SUMMARY

A magnetic modular storage assembly is configured to efficiently store components. The magnetic modular storage assembly has a thick middle container. A lid is detachably coupled to the thick middle container. A thin middle container is detachably coupled to the thick middle container. A lower container is detachably coupled to the thin middle container. The lid, the thick middle container, the thin middle container, and the lower container efficiently store components.

The thick middle container further comprises a thick middle container upper edge and a thick middle lower edge. Thick middle container upper edge magnets are attached to the thick middle container upper edge. Thick middle container lower edge magnets are attached to the thick middle container lower edge.

The lid further comprises a lid lower edge magnets attached to a lid lower edge. The lid lower edge magnets are magnetically coupled to the thick middle container upper edge magnets to detachably coupled the lid to the thick middle container.

The thin middle container further comprises a thin middle container lower edge and a thin middle container upper edge. Thin middle container lower edge magnets are attached to thin middle container lower edge. Thin middle container upper edge magnets are attached to thin middle container upper edge. The thick middle container lower edge magnets are magnetically coupled to the thin middle container upper edge magnets to detachably couple the thin middle container to the thick middle container.

A thin middle container magnetic sheet insert is joined to the thin middle container. Magnetic brushes and magnetic paint pans are joined to the thin middle container magnetic sheet insert.

A magnetic long divider and a magnetic short divider, joined to the thick middle container magnetic sheet insert. Non-magnetic tools are placed on the thick middle container magnetic sheet insert between the magnetic long divider and the magnetic short divider. Magnetic bottles and interchangeable tops for the magnetic bottles are joined to the thick middle container magnetic sheet insert.

The lower container further comprises a lower container upper edge. Lower container upper edge magnets are joined to the lower container upper edge. The lower container upper edge magnets are magnetically coupled to the thin middle container lower edge magnets to detachably couple the lower container to the thin middle container.

A lower container magnetic sheet insert is joined to lower container. A magnetic cubic container is magnetically coupled to the lower container magnetic sheet insert and further comprising an upward facing magnetic label and a magnetic five-well pallet with a magnetic cover.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
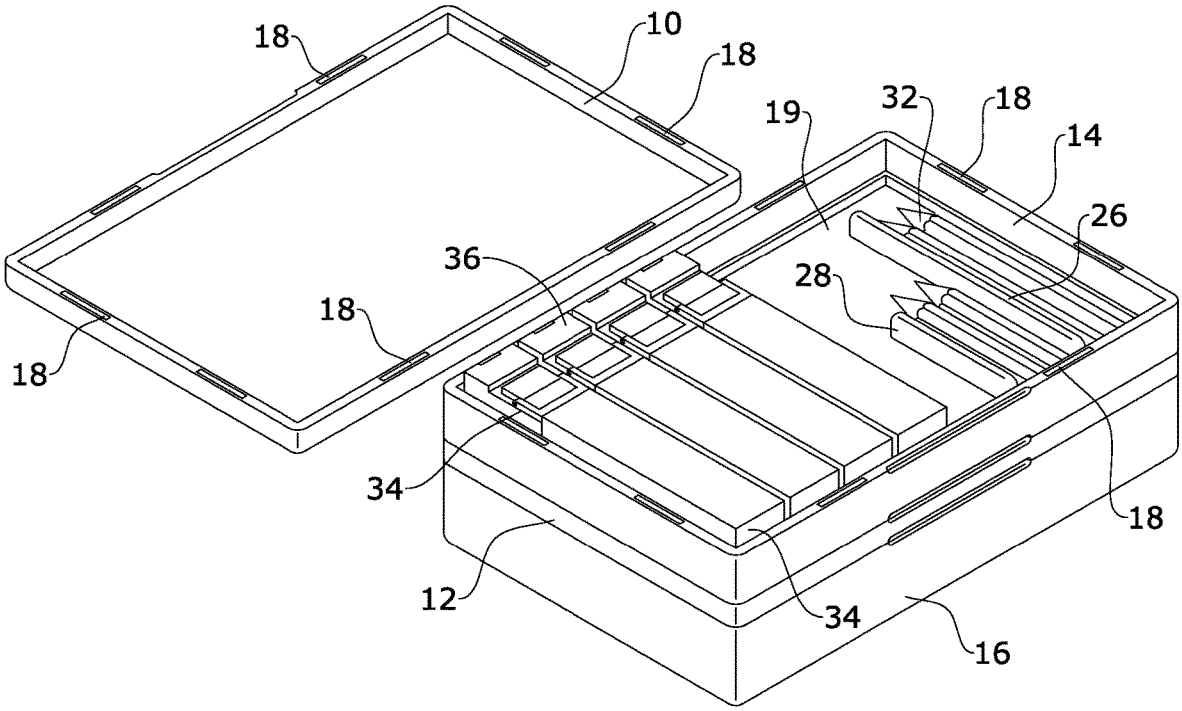
FIG. 1 shows a perspective view of one embodiment of the present invention.
Figure 2:
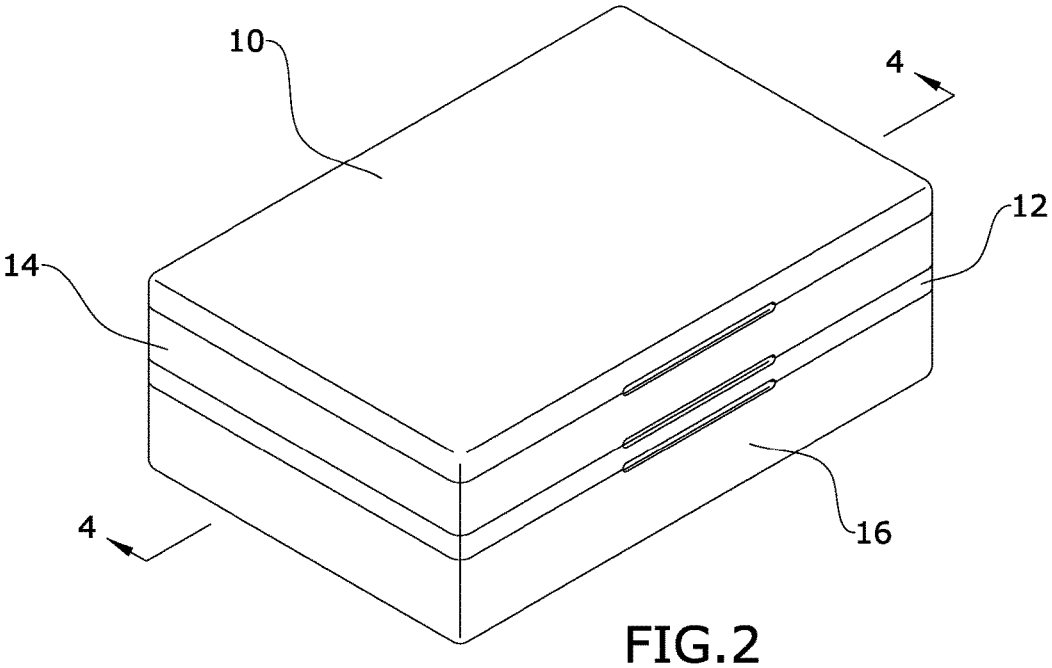
FIG. 2 shows a perspective view of one embodiment of the present invention.
Figure 3:
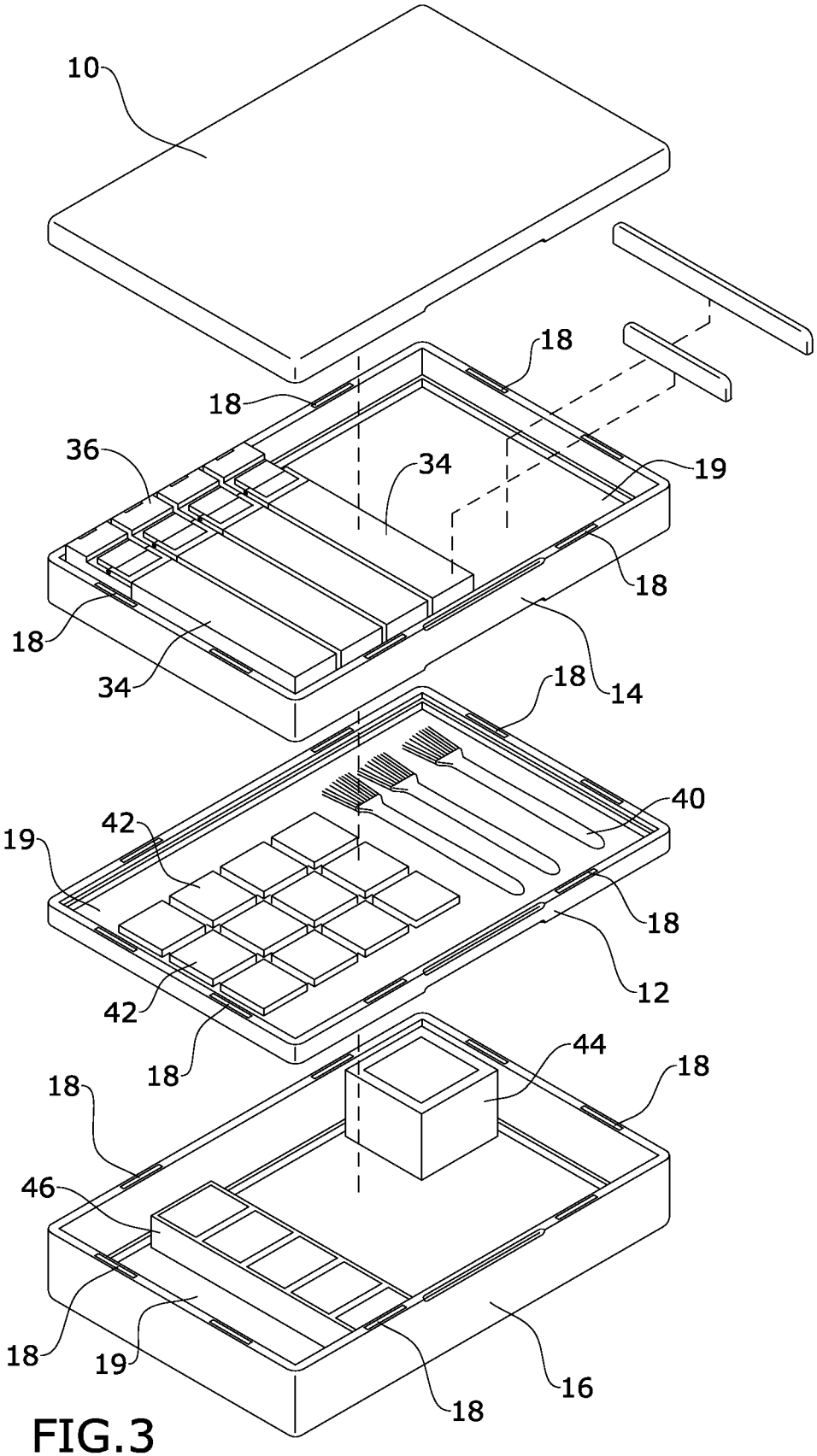
FIG. 3 shows an exploded view of one embodiment of the present invention.
Figure 4:
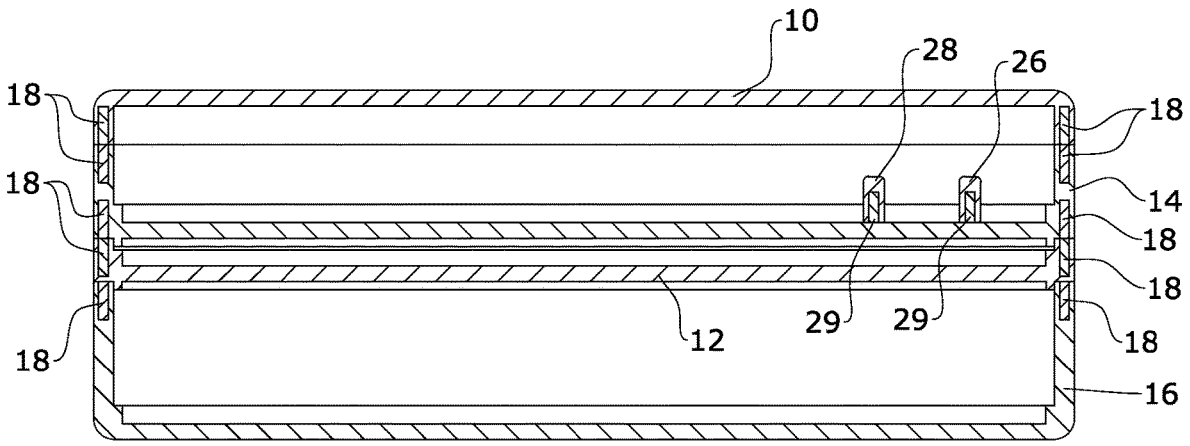
FIG. 4 shows a section view of one embodiment of the present invention taken along line 4-4 in FIG. 2.
Figure 5:
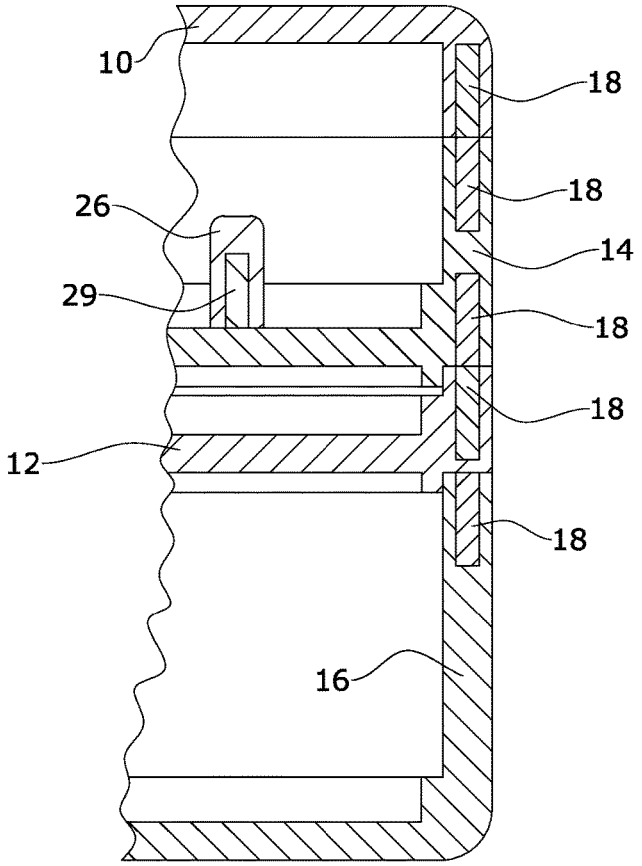
FIG. 5 shows a detailed section view of one embodiment of the present invention.
Figure 6:
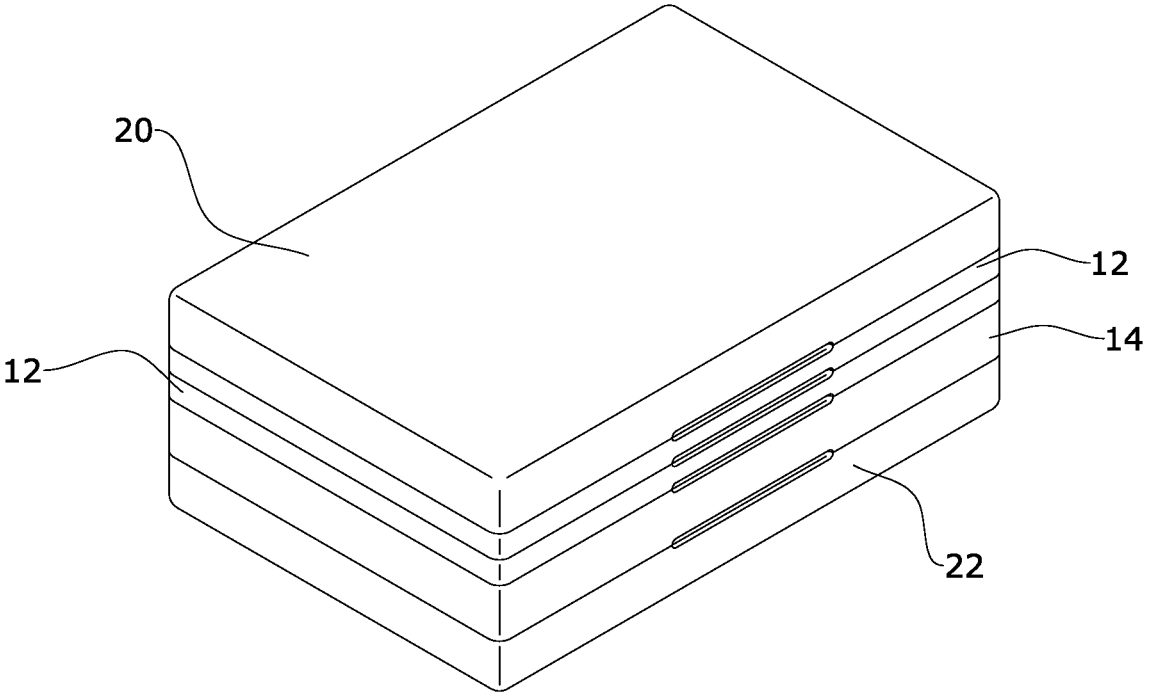
FIG. 6 shows a perspective view of one embodiment of the present invention.
Figure 7:
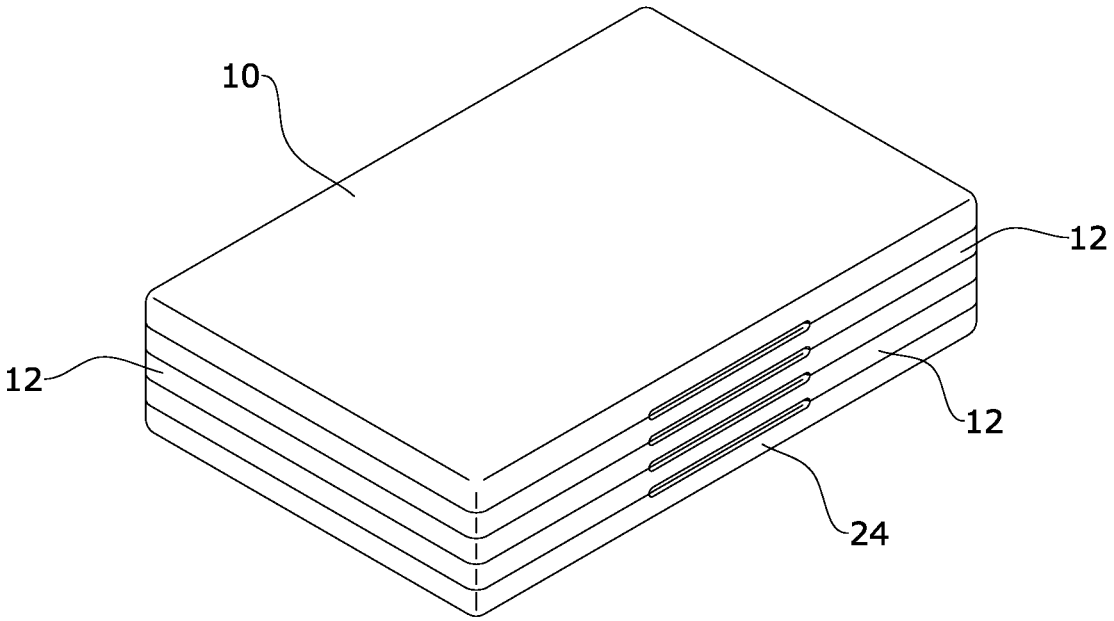
FIG. 7 shows a perspective view of one embodiment of the present invention.

By way of example, and referring to FIG. 1, one embodiment of a magnetic modular storage case further comprises a thick middle container 14 with a thick middle container upper edge and a thick middle lower edge. Thick middle container upper edge magnets 18 are attached to the thick middle container upper edge. Thick middle container lower edge magnets 18 are attached to the thick middle container lower edge.

A lid 10 further comprises a lid lower edge. Lid lower edge magnets 18 are attached to the lid lower edge. The lid lower edge magnets 18 are magnetically coupled to the thick middle container upper edge magnets 18 to detachably coupled the lid 10 to the thick middle container 14.

A thin middle container 12 further comprises a thin middle container lower edge and a thin middle container upper edge. Thin middle container lower edge magnets 18 are attached to thin middle container lower edge. Thin middle container upper edge magnets 18 are attached to thin middle container upper edge. The thin middle container 12 is joined to a thin middle container magnetic sheet insert 19. Magnetic brushes 40 and magnetic paint pans 42 are joined to the thin middle container magnetic sheet insert 19.

The thick middle container 14 further comprises a thick middle container magnetic sheet insert 19. The thick middle container magnetic sheet insert 19 is joined to a magnetic long divider 26 and a magnetic short divider 28. Non-magnetic tools 32 can be placed on the thick middle container magnetic sheet insert 19 between the magnetic long divider 26 and the magnetic short divider 28. The thick middle container magnetic sheet insert 19 is joined to magnetic bottles 34 and interchangeable tops 36 for the magnetic bottles 34.

The thick middle container lower edge magnets 18 are magnetically coupled to the thin middle container upper edge magnets 18 to detachably couple the thin middle container 12 to the thick middle container 14.

A lower container 16 further comprises a lower container upper edge. Lower container upper edge magnets 18 are joined to the lower container upper edge. The lower container upper edge magnets 18 are magnetically coupled to the thin middle container lower edge magnets 18 to detachably couple the lower container 16 to the thin middle container 12.

The lower container 16 is joined to a lower container magnetic sheet insert 19. The lower container magnetic sheet insert 19 is attached to a magnetic cubic pomade container 44 having an upward facing label and a magnetic five-well pallet with a magnetic cover 46.

Figure 8:
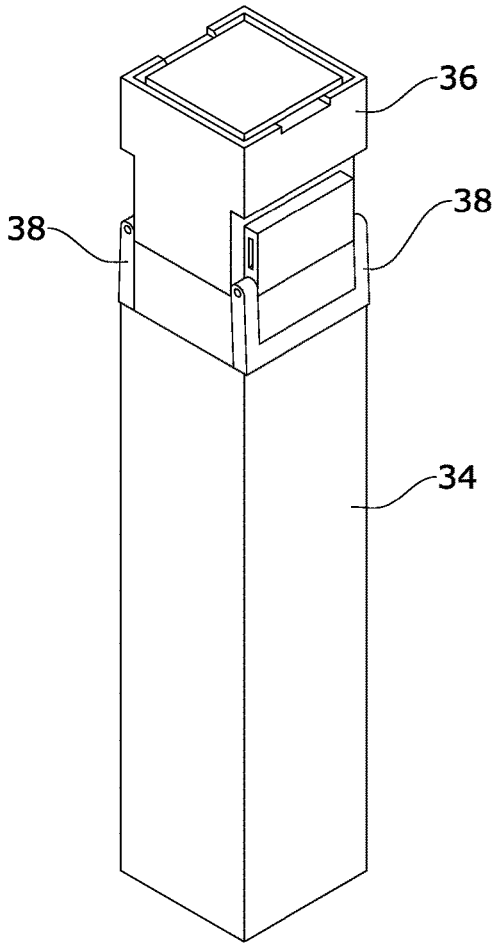
FIG. 8 shows a perspective view of one embodiment of a magnetic bottle of the present invention showing a magnetic double latch top with a magnetic label.
Figure 9:
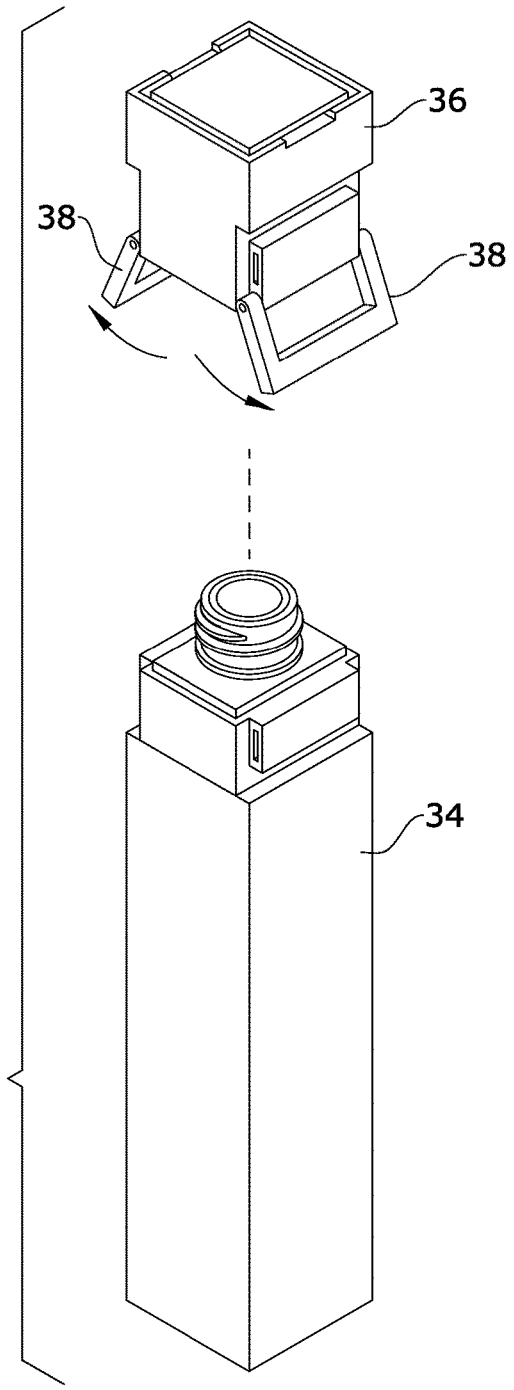
FIG. 9 shows an exploded view of one embodiment of a magnetic bottle of the present invention showing a magnetic double latch top with a magnetic label.
Figure 10:
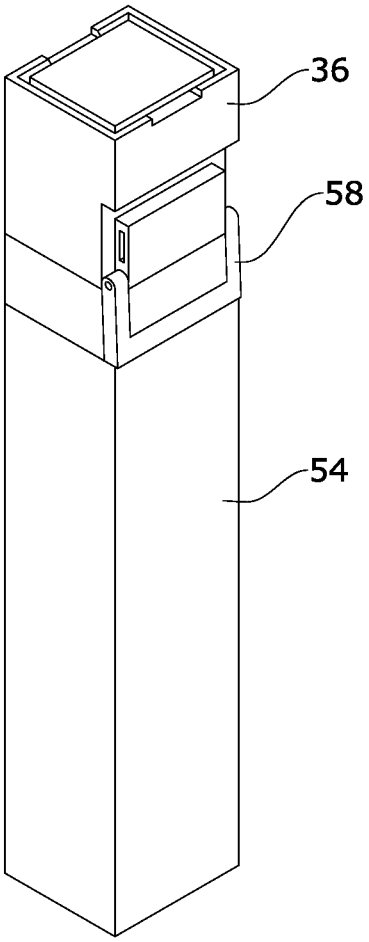
FIG. 10 shows a perspective view of one embodiment of the present invention showing a magnetic single latch top with a magnetic label.
Figure 11:
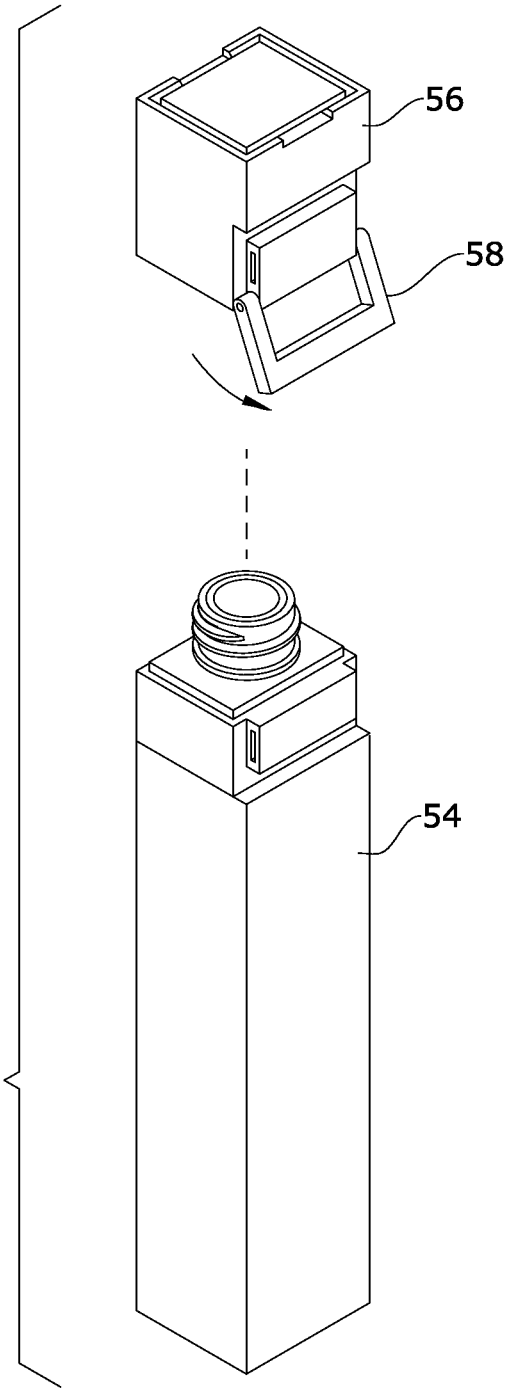
FIG. 11 shows an exploded view of one embodiment of the present invention showing a magnetic single latch top with a magnetic label.

Turning to FIG. 8 and FIG. 9, the magnetic bottle 34 is joined to the magnetic interchangeable top 36 with a pair of top clasps 38. Turning to FIG. 10 and FIG. 11, the magnetic bottle 34 is joined to the magnetic interchangeable top 56 with a single top clasp 58. The magnetic sheet insert 19 can be joined to the magnetic interchangeable top 36, 56 to secure the magnetic bottle 34 to the magnetic sheet insert 19.

Figure 15:
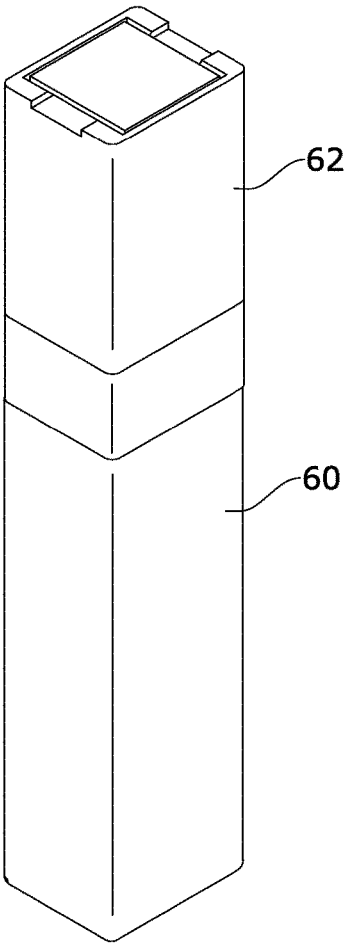
FIG. 15 shows a perspective view of one embodiment of a bottle of the present invention showing a magnetic twist top with a magnetic label.
Figure 16:
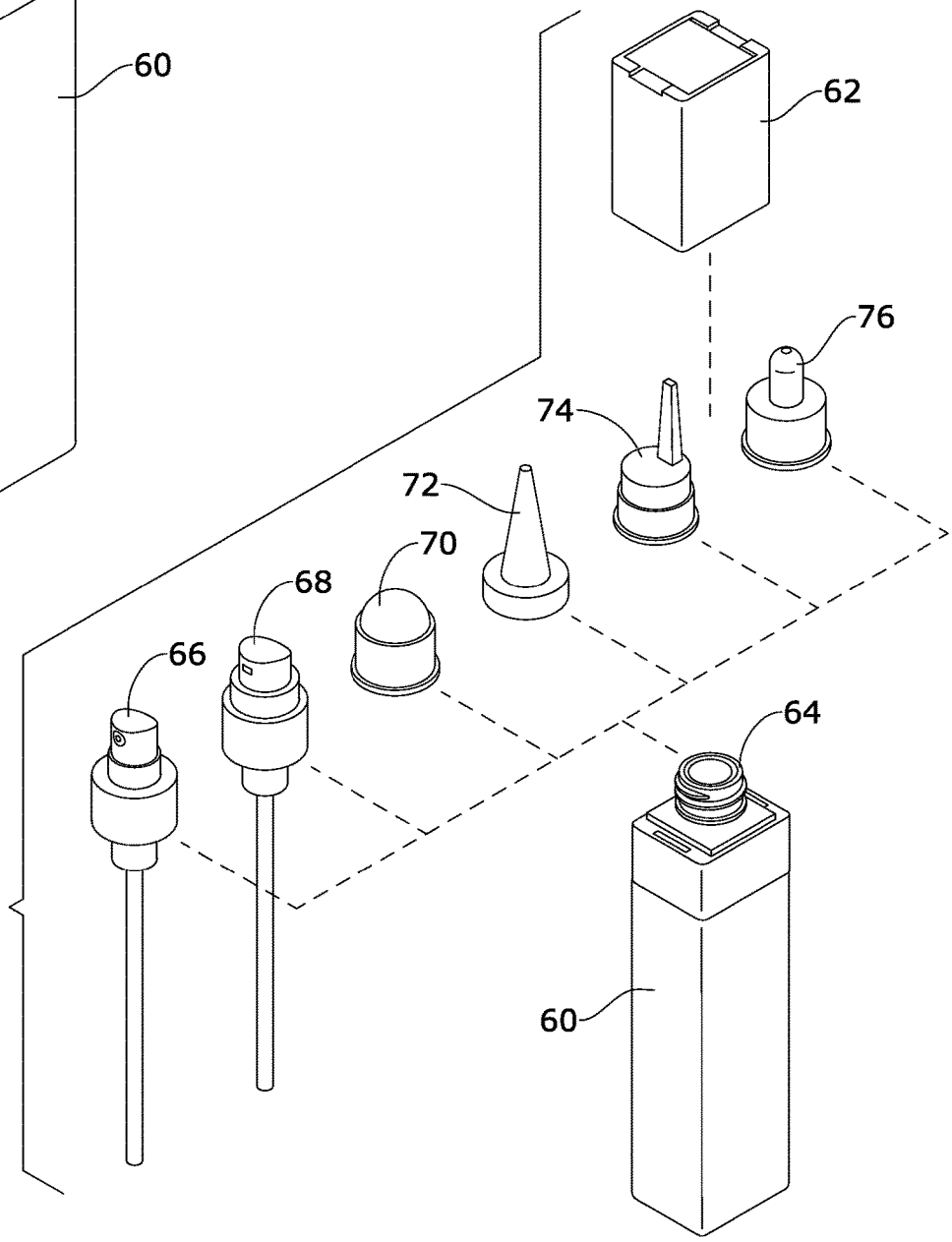
FIG. 16 shows an exploded view of various embodiment of a bottle of the present invention showing various versions of interchangeable tops, spray, pump, roller ball, dropper and squeeze.

Turning to FIG. 15 and FIG. 16, a magnetic bottle 60 is joined to a mechanical top 62. Magnetic bottle 60 further comprises a threaded neck 64. The threaded neck 64 can be attached to a spray top 66, a pump top 68, a roller ball top 70, a central nozzle top 72, a side nozzle top 74, and a dropper top 76.

Figure 12:
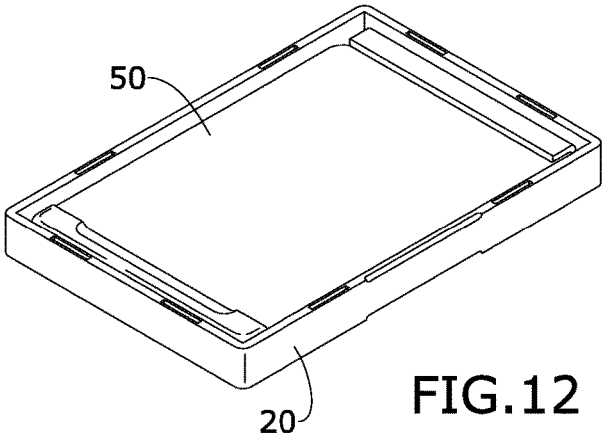
FIG. 12 shows a perspective view of one embodiment of the present invention showing a magnetic dual sided LED mirror.
Figure 13:
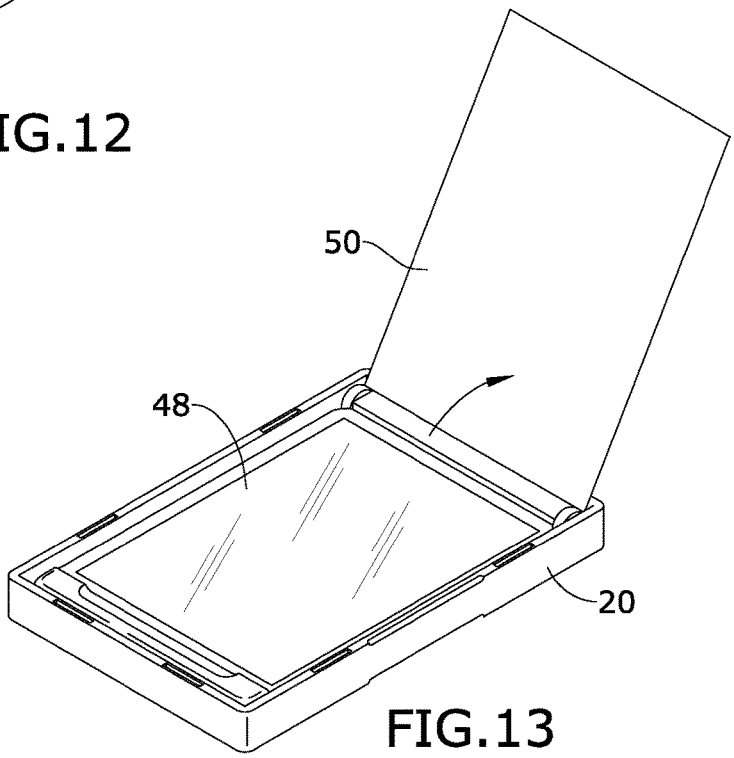
FIG. 13 shows a perspective view of one embodiment of the present invention showing an opened magnetic dual sided LED mirror.
Figure 14:
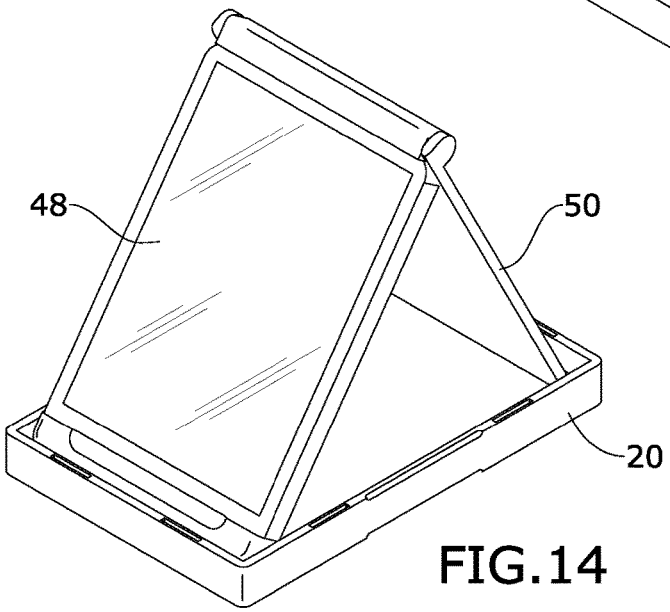
FIG. 14 shows a perspective view of one embodiment of the present invention showing a fully expanded dual sided LED mirror.

Turning to FIGS. 12-14, the thick top container 20 can be joined to a mirror 48. The mirror 48 is joined to a mirror stand 50 with a hinge. In some embodiments, the mirror 48 can be a rechargeable touch screen such as an LED lighted screen with three modes.

Figure 17:
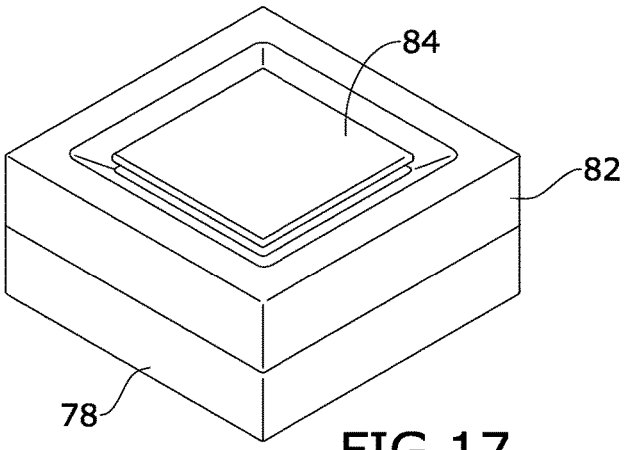
FIG. 17 shows a perspective view of one embodiment of the present invention showing a magnetic cubic container with a magnetic twist top and a magnetic label.
Figure 18:
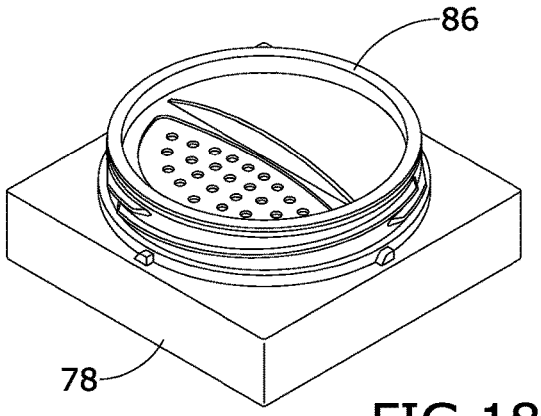
FIG. 18 shows a perspective view of one embodiment of the present invention showing a removable sift with a twist lid to open, close and to allow for various amounts of mediums and products to be poured.
Figure 19:
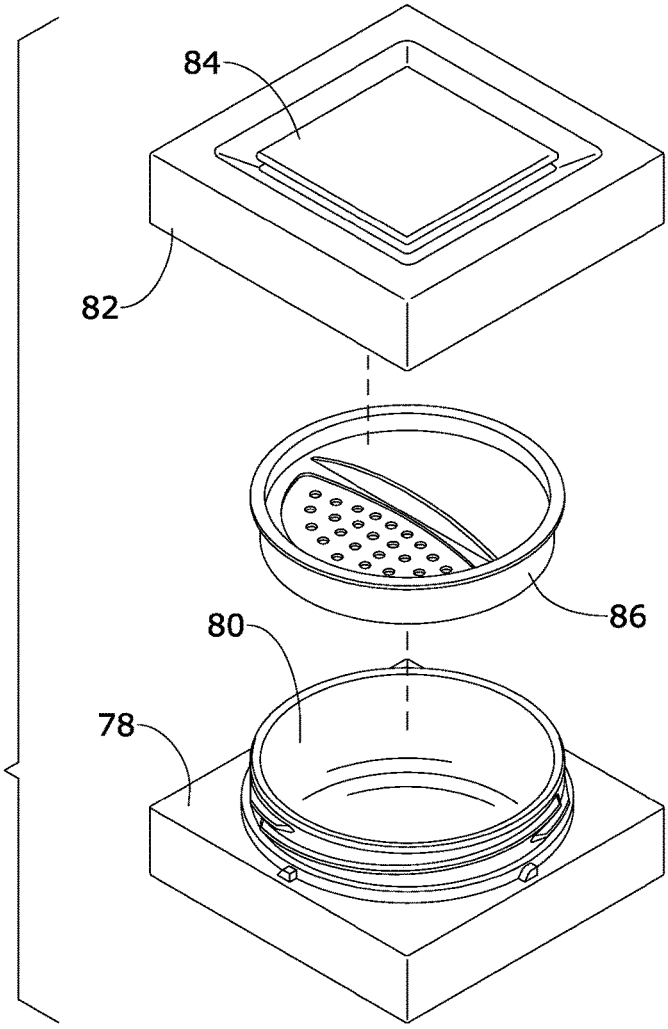
FIG. 19 shows an exploded view of one embodiment of a square container of the present invention showing a deep well cavity for various products; the sift inserts for powder and course mediums, a magnetic top and a magnetic label.
Figure 20:
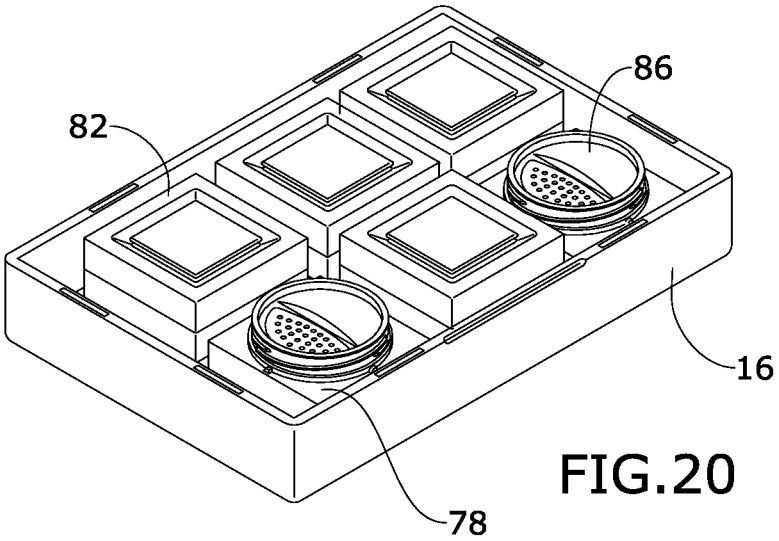
FIG. 20 shows a perspective view of one embodiment of the present invention showing a magnetic deep layer filled with six cubic containers, all fit to a magnetic vinyl sheet by a magnetic base.

Turning to FIGS. 17-19, a container 78 can be connected to a threaded opening 80. The threaded opening 80 can be covered by a lid 82 having a magnetic label 84. A sift 86 is arranged in the threaded opening 80. The sift 86 can be used to dispense dry products. As shown in FIG. 20, a lower container 16 can be used to store a combination of containers 78 with or without lids 46, 82 as desired. One could also double stack magnetically a five well pallet and would be able to fit a total of eight pallets and six containers 82 into deep layer.

Figure 21:
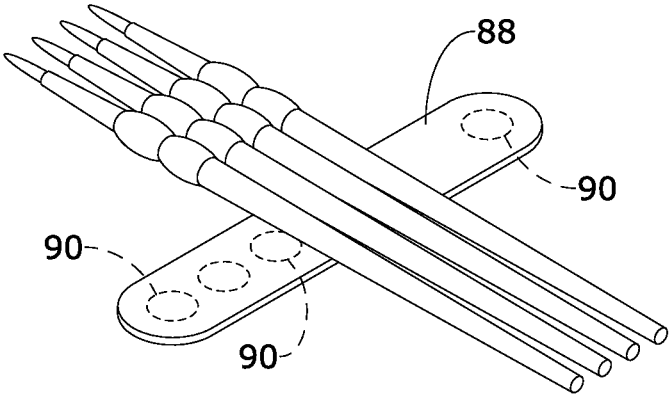
FIG. 21 shows a perspective view of one embodiment of the present invention showing a magnetic strap with various size tightness to strap together various products such as pens, brushes, and pencils.
Figure 22:
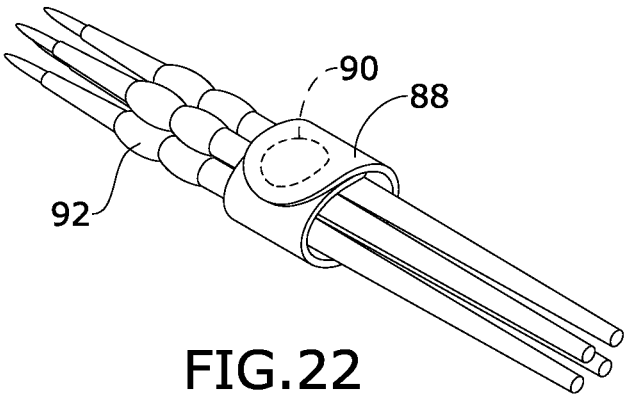
FIG. 22 shows a perspective view of one embodiment of the present invention showing the magnetic strap holding together paint brushes tightly with magnetic force.

Turning to FIGS. 21-22, brushes, pencils, markers, and any non-magnetic items that can be bundled together and be arranged into a bunch with a magnetic strap 88.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A magnetic modular storage assembly, configured to efficiently store components; the magnetic modular storage assembly comprising:

a thick middle container; further comprising:

a thick middle container upper edge and a thick middle lower edge;

thick middle container upper edge magnets, attached to the thick middle container upper edge;

thick middle container lower edge magnets, attached to the thick middle container lower edge;

a thin middle container lower edge and a thin middle container upper edge;

thin middle container lower edge magnets, attached to thin middle container lower edge;

thin middle container upper edge magnets, attached to thin middle container upper edge;

wherein the thick middle container lower edge magnets are magnetically coupled to the thin middle container upper edge magnets to detachably couple the thin middle container to the thick middle container a lid, detachably coupled to the thick middle container; the lid further comprising:

lid lower edge magnets, attached to a lid lower edge;

wherein the lid lower edge magnets are magnetically coupled to the thick middle container upper edge magnets to detachably coupled the lid to the thick middle container;

a thin middle container, detachably coupled to the thick middle container;

a lower container, detachably coupled to the thin middle container;

wherein the lid, the thick middle container, the thin middle container, and the lower container efficiently store components.

2. The magnetic modular storage assembly of claim 1, further comprising:

a thin middle container magnetic sheet insert, joined to the thin middle container; and magnetic brushes and magnetic paint pans are joined to the thin middle container magnetic sheet insert.

3. The magnetic modular storage assembly of claim 2, further comprising:

a magnetic long divider and a magnetic short divider, joined to the thick middle container magnetic sheet insert;

non-magnetic tools, placed on the thick middle container magnetic sheet insert between the magnetic long divider and the magnetic short divider;

magnetic bottles and interchangeable tops for the magnetic bottles, joined to the thick middle container magnetic sheet insert.

4. The magnetic modular storage assembly of claim 3, wherein the lower container further comprises:

a lower container upper edge;

lower container upper edge magnets, joined to the lower container upper edge;

wherein the lower container upper edge magnets are magnetically coupled to the thin middle container lower edge magnets to detachably couple the lower container to the thin middle container.

5. The magnetic modular storage assembly of claim 4, further comprising:

a lower container magnetic sheet insert, joined to lower container;

a magnetic cubic container, magnetically coupled to the lower container magnetic sheet insert and further comprising an upward facing label, a magnetic five-well pallet with a magnetic cover, and magnetic interchangeable bottles.

* * * * *